US011440324B2

(12) United States Patent
Tsuji

(10) Patent No.: US 11,440,324 B2
(45) Date of Patent: Sep. 13, 2022

(54) INK DISCHARGE DEVICE AND IMAGE FORMING APPARATUS

(71) Applicant: KYOCERA Document Solutions Inc., Osaka (JP)

(72) Inventor: Kikunosuke Tsuji, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 78 days.

(21) Appl. No.: 17/192,772

(22) Filed: Mar. 4, 2021

(65) Prior Publication Data

US 2021/0206172 A1 Jul. 8, 2021

Related U.S. Application Data

(62) Division of application No. 16/673,101, filed on Nov. 4, 2019, now Pat. No. 10,967,640.

(30) Foreign Application Priority Data

Nov. 21, 2018 (JP) ..... JP2018-218593

(51) Int. Cl.
*B41J 2/175* (2006.01)

(52) U.S. Cl.
CPC ..... *B41J 2/175* (2013.01)

(58) Field of Classification Search
CPC .... B41J 2/175; B41J 2/17513; B41J 2/17596; B41J 2/045
See application file for complete search history.

(56) References Cited

U.S. PATENT DOCUMENTS

| | | | | |
|---|---|---|---|---|
| 8,356,891 | B2 | 1/2013 | Takata | |
| 9,004,656 | B2 * | 4/2015 | Takahagi | B41J 2/175 347/85 |
| 2011/0050766 | A1 | 3/2011 | Matsumoto et al. | |
| 2013/0106963 | A1 | 5/2013 | Kawase et al. | |

FOREIGN PATENT DOCUMENTS

| | | | |
|---|---|---|---|
| CN | 103660569 | A | 3/2014 |
| JP | 2010194861 | A | 9/2010 |

OTHER PUBLICATIONS

IP.com search (Year: 2022).*
IP.com search (Year: 2020).
The extended European search report issued by the European Patent Office dated Mar. 12, 2020, which corresponds to European Patent Application No. 19206419.4-1017 and is related to U.S. Appl. No. 16/673,101.
An Office Action by China National Intellectual Property Administration dated Sep. 29, 2020, which corresponds to Chinese Patent Application No. 201911076426.4 and is related to U.S. Appl. No. 16/673,101 with English language translation.

* cited by examiner

*Primary Examiner* — Lisa Solomon
(74) *Attorney, Agent, or Firm* — Studebaker & Brackett PC

(57) ABSTRACT

An ink discharge device includes one or more recording heads discharging an ink and a damper. The recording head includes a head side coupling. The damper includes a damper side coupling which is connected to the head side coupling along a connecting direction. The damper side coupling is provided so as to be movable along the connecting direction.

19 Claims, 6 Drawing Sheets

INK DISCHARGE DEVICE AND IMAGE FORMING APPARATUS

INCORPORATION BY REFERENCE

This application is a Divisional of U.S. patent application Ser. No. 16/673,101 filed Nov. 4, 2019, and is based on and claims the benefit of priority from Japanese Patent application No. 2018-218593 filed on Nov. 21, 2018, the entire contents of which are incorporated herein by reference.

BACKGROUND

The present disclosure relates to an ink discharge device and an image forming apparatus including this ink discharge device.

Heretofore, an inkjet image forming apparatus forms an image on a recording medium by discharging an ink from an ink discharge device to the recording medium.

For example, the ink discharge device includes a recording head which has a nozzle discharging the ink and a damper which reduces pressure variation of the ink in the recording head.

In the ink discharge device as described above, if one damper is provided in common to a plurality of recording heads, constitution of the ink discharge device can be simplified compared with a case where the same number of the dampers are provided corresponding to the plurality of recording heads, and costs can be reduced. When the one damper is provided in common to the plurality of recording heads like this, in order that an assembly property of each recording head and the damper is improved, it is preferred that the respective recording heads are connected to the damper by couplings.

However, in a case where such a connection method is adopted, when variation occurs in heights of the couplings of the respective recording heads, a part of the couplings may not match the others in a height. Therefore, it may become difficult to attach the damper to each recording head.

SUMMARY

An ink discharge device includes one or more recording heads discharging an ink and a damper. The recording head includes a head side coupling. The damper includes a damper side coupling which is connected to the head side coupling along a connecting direction. The damper side coupling is provided so as to be movable along the connecting direction.

Alternatively, an ink discharge device includes one or more recording heads discharging an ink and a damper. The recording head includes a head side coupling. The damper includes a damper side coupling which is connected to the head side coupling along a connecting direction. The head side coupling is provided, in a state being connected to the damper side coupling, so as to be movable along the connecting direction.

An image forming apparatus includes an apparatus body having a conveying path of a recording medium, and any one of the above-mentioned ink discharge devices which discharges the ink to the recording medium conveyed on the conveying path.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to the drawings, an image forming apparatus 1 according to an embodiment of the present disclosure will be described. Hereinafter, for convenience of description, it will be described so that the front side of the image forming apparatus 1 is positioned at the near side on a paper sheet of FIG. 1. Arrows Fr, Rr, L, R, U and Lo in each figure respectively indicate a front side, a rear side, a left side, a right side, an upper side and a lower side of the image forming apparatus 1.

First, entire structure of the image forming apparatus 1 disclosure will be described.

Figure 1:
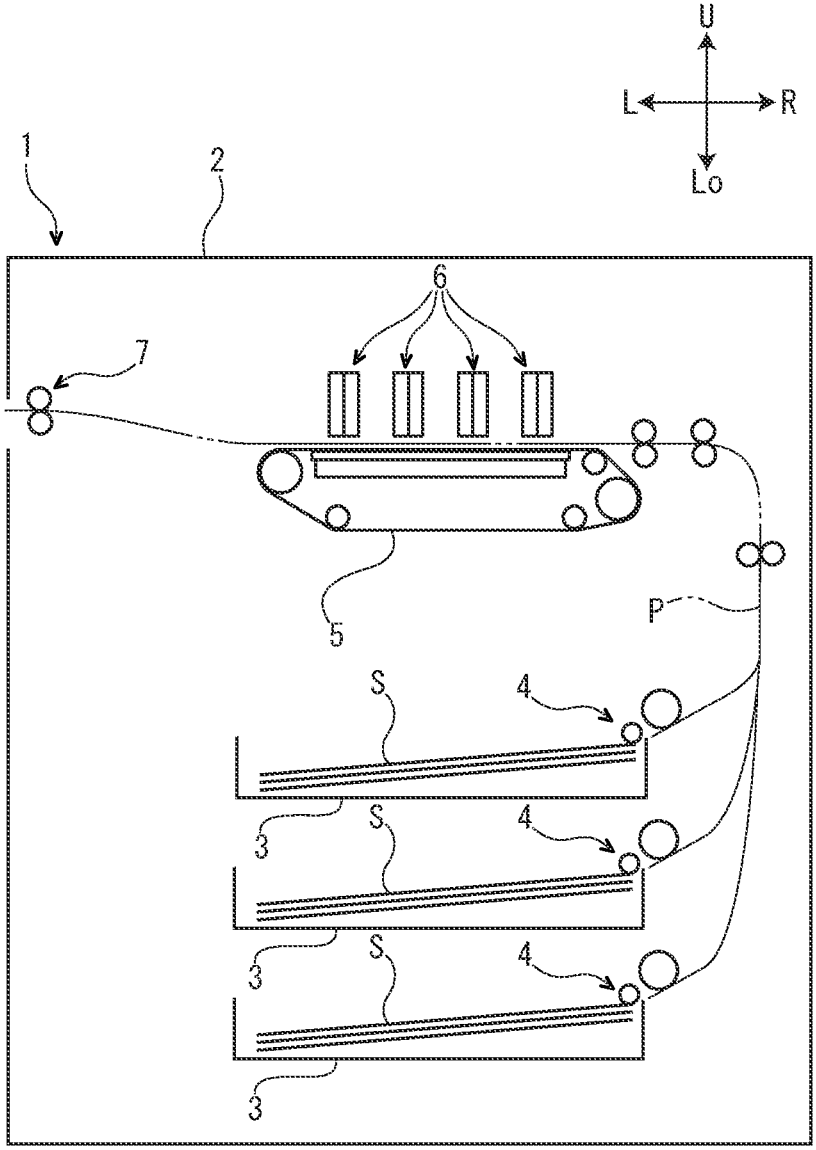
FIG. 1 is a sectional view schematically showing an image forming apparatus according to an embodiment of the present disclosure.

As shown in FIG. 1, the image forming apparatus is, for example, an inkjet color printer. The image forming apparatus 1 includes a box-formed apparatus body 2. In a lower part of the apparatus body 2, a plurality of sheet feeding cartridges 3 are provided. In each sheet feeding cartridge 3, a sheet S (an example of a recording medium) is stored.

Inside of the apparatus body 2, a conveying path P of the sheet S is provided. At an upstream end part of the conveying path P, a plurality of sheet feeding parts 4 are provided. At a middle stream part of the conveying path P, a conveying belt 5 and four ink discharge devices 6 are provided. The ink discharge devices 6 respectively correspond to colors of black, cyan, magenta, and yellow. At a downstream end part of the conveying path 6, a sheet ejecting part 7 is provided.

Next, image forming operation of the image forming apparatus 1 including such a configuration will be explained.

First, the sheet S is picked up from each sheet feeding cartridge 3 by each sheet feeding part 4. The sheet S picked up from each sheet feeding cartridge 3 is conveyed to a downstream side on the conveying path P, and is adsorbed onto the upper surface of the conveying belt 5. Each ink discharge device 6 discharges the ink to the sheet S absorbed onto the upper surface of the conveying belt 5. Thereby, a color image is formed on the sheet S. The sheet S on which the color image is formed is conveyed to the further downstream side on the conveying path P, and is ejected to an outside of the apparatus body 2 by the sheet ejecting part 7.

Next, with reference to FIG. 2 to FIG. 6, each ink discharge device 6 will be described.

Hereinafter, "upstream side" or "downstream side" simply described indicates "upstream side" or "downstream side" in a stream direction (refer to the dotted arrow in FIG. 2) of the ink in each ink discharge device 6.

Figure 2:
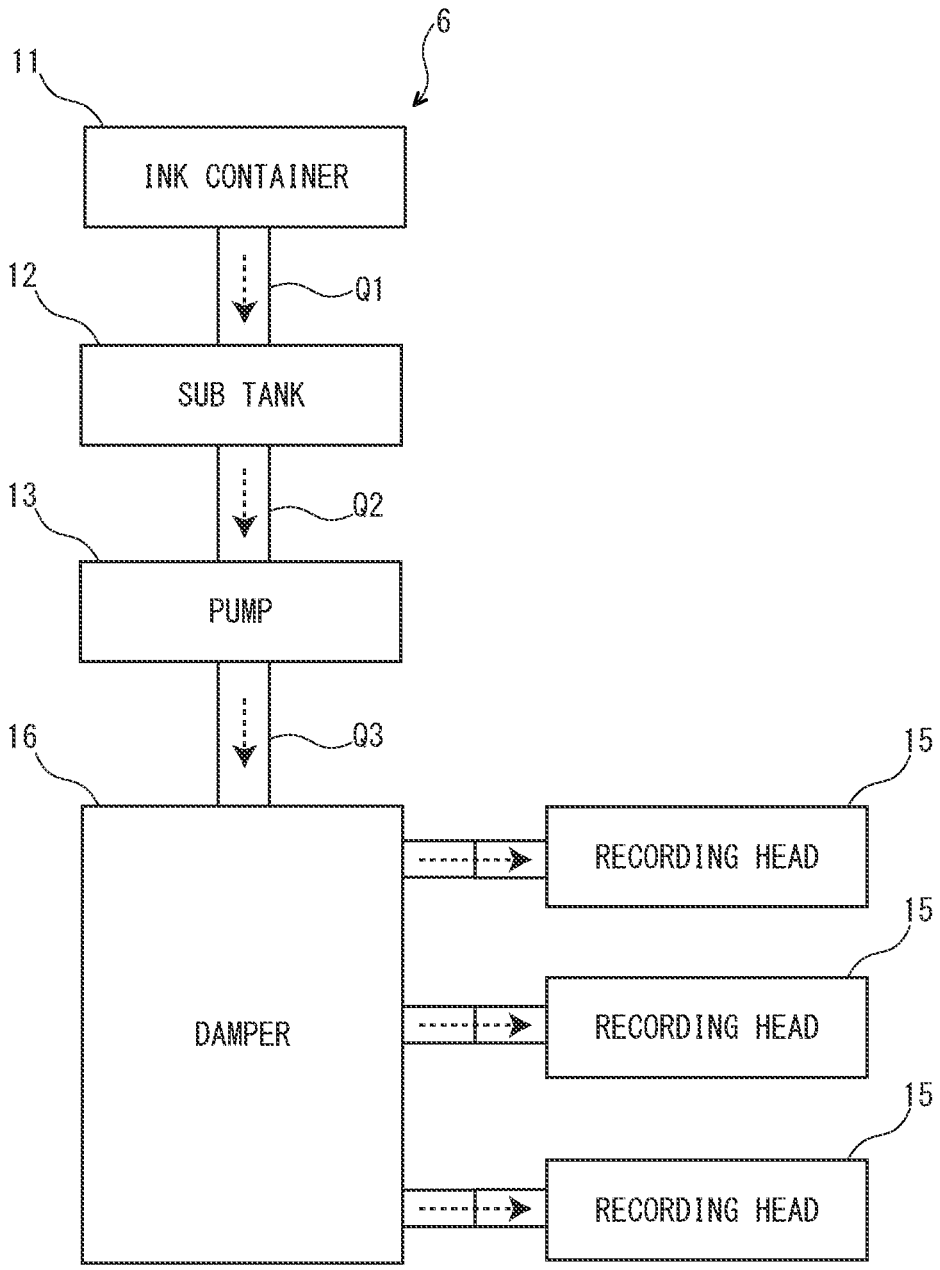
FIG. 2 is a block diagram showing an ink discharge device according to the embodiment of the present disclosure.

As shown in FIG. 2, each ink discharge device 6 includes an ink container 11, a sub tank 12 located at the downstream side of the ink container 11, a pump 13 located at the downstream side of the sub tank 12, three recording heads 15 located at the downstream side of the pump 13, one damper 16 located at the downstream side of the pump 13 and at the upstream side of the recording heads 15. The ink container 11 and the sub tank 12 are connected by a first flow path Q1, and the sub tank 12 and the pump 13 are connected by a second flow path Q2, and the pump 13 and the damper 16 are connected by a third flow path Q3. Hereinafter, the description of the configuration of the ink container 11, the sub tank 12 and the pump 13 will be omitted, only the configuration of each recording head 15 and the damper 16 will be described.

Figure 3A:
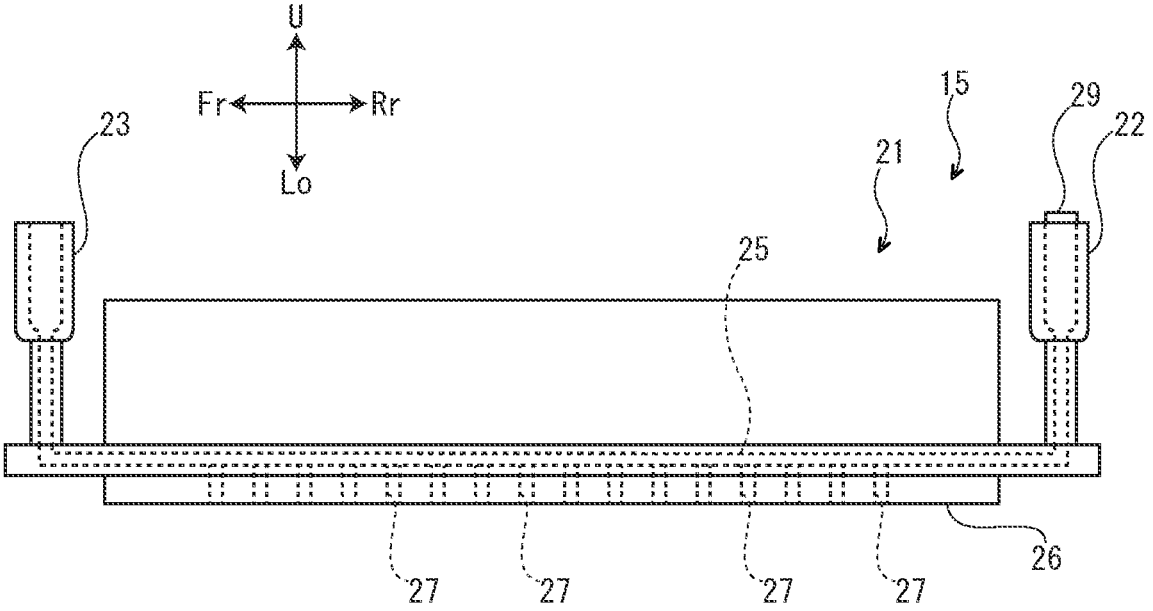
FIG. 3A is a side view showing a recording head according to the embodiment of the present disclosure.
Figure 3B:
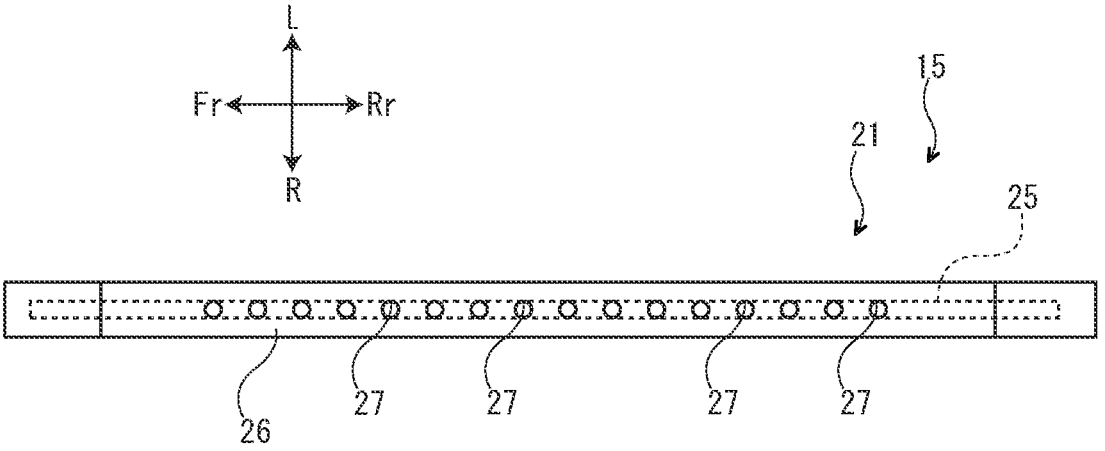
FIG. 3B is a bottom view showing the recording head according to the embodiment of the present disclosure.

As shown in FIG. 3A and FIG. 3B, each recording head 15 of each ink discharge device 6 has a long shape extended in a front/rear direction (a width direction orthogonal to a conveying direction of the sheet S passing through the ink discharge device 6). Each recording head includes a head body 21, a head side coupling 22 provided at the rear side (one side of the front/rear direction) of the head body 21, and an ejection coupling 23 provided at the front side (the other side of the front/rear direction) of the head body 21.

Inside of the head body 21 of each recording head 15, an ink flow path 25 in which the ink flows is provided. The ink flow path 25 is extended along the front/rear direction. At a lower surface of the head body 21, a nozzle face 26 is provided. On the nozzle face 26, a plurality of nozzles 27 are arranged along the front/rear direction. Each nozzle 27 is connected to the ink flow path 25 at the downstream side of the head side coupling 22 and the upstream side of the ejection coupling 23. Each nozzle 27 faces to the conveying path P (refer to FIG. 1) of the sheet S.

As shown in FIG. 3A and FIG. 3B, the head side coupling 22 of each recording head 15 has a long cylindrical shape extended in an up/down direction, and is opened upwardly. A lower end part of the head side coupling 22 is connected to a rear end part (an end part at the upstream side) of the ink flow path 25 of the head body 21. The head side coupling 22 is fixedly provided to the head body 21. At an upper end part of the head side coupling 22, a stopper 29 which is movable in a horizontal direction is provided.

The ejection coupling 23 of each recording head 15 has a long cylindrical shape extended in the up/down direction, and is opened upwardly. A lower end part of the ejection coupling 23 is connected to a front end part (an end part at the downstream side) of the ink flow path 25 of the head body 21. The ejection coupling 23 is connected to the sub tank 12 (refer to FIG. 2) via a flow path (not shown).

Figure 4:
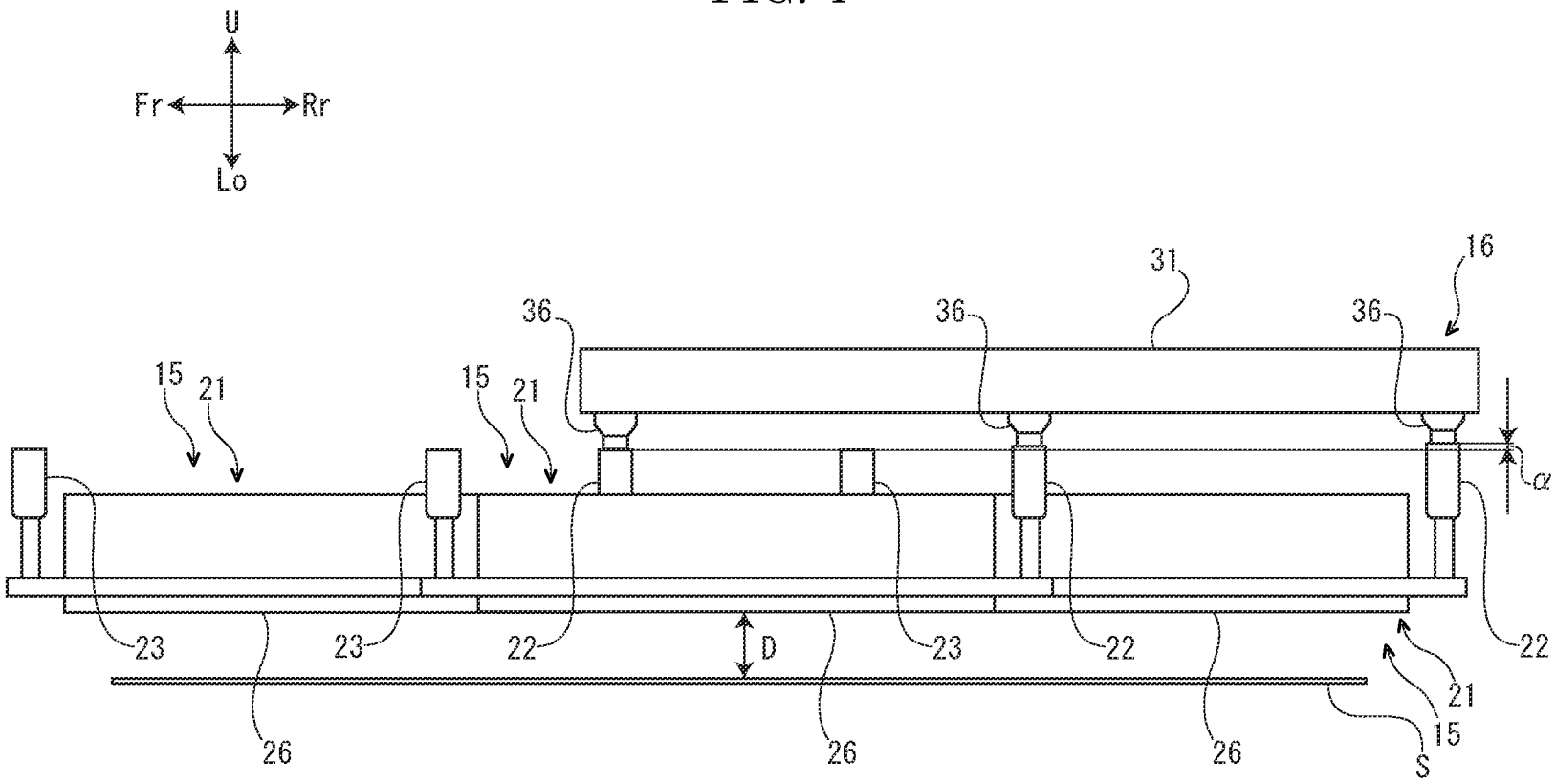
FIG. 4 is a side view showing the recording head and a damper according to the embodiment of the present disclosure.

As shown in FIG. 4, the damper 16 has a long shape extended in the front/rear direction. The one damper 16 is provided in common to the three recording heads 15. The damper 16 is located above the recording heads 15.

Figure 5:
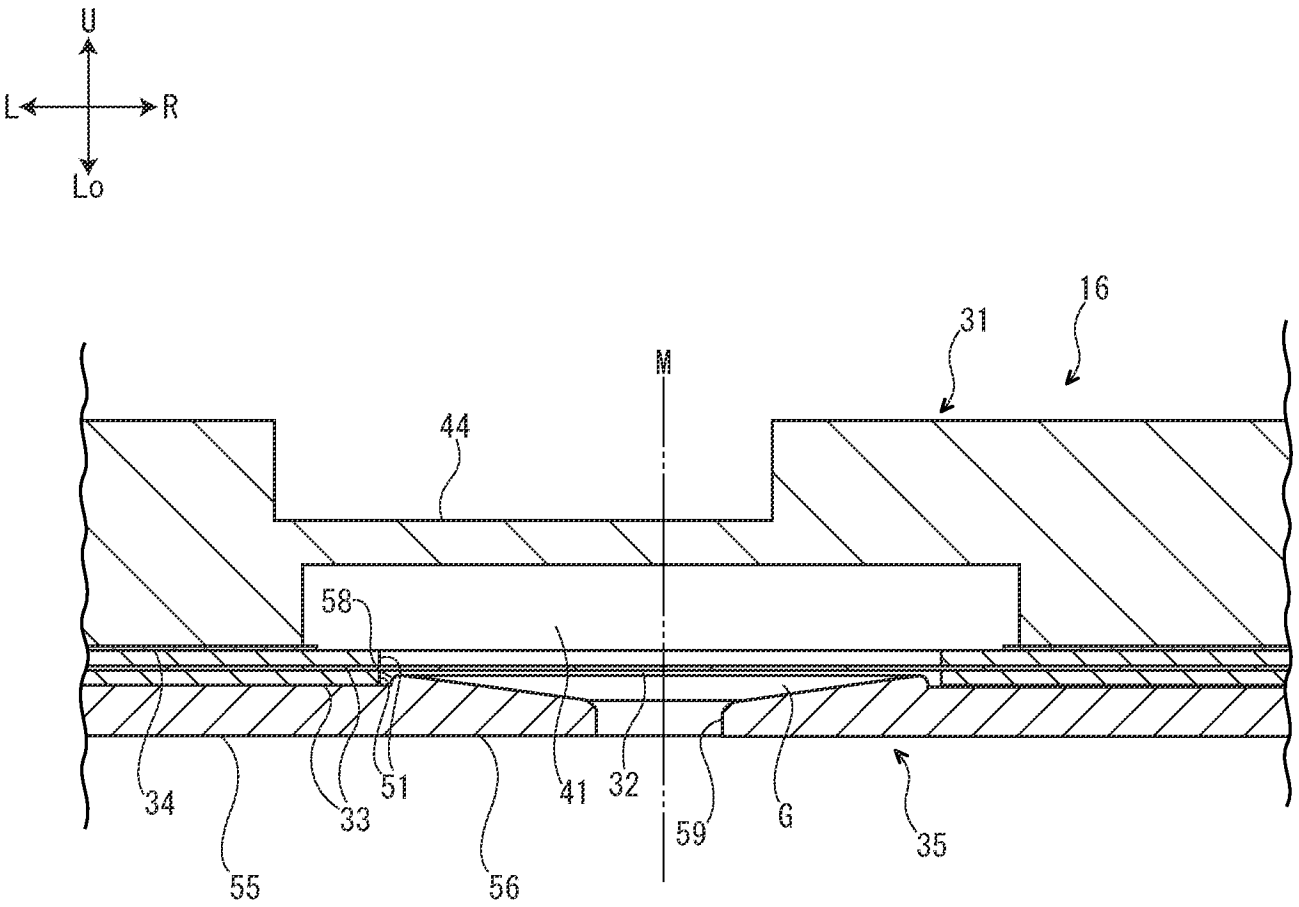
FIG. 5 is a sectional view showing the damper, in a state that a film is formed in a flat board shape, according to the embodiment of the present disclosure.
Figure 6:
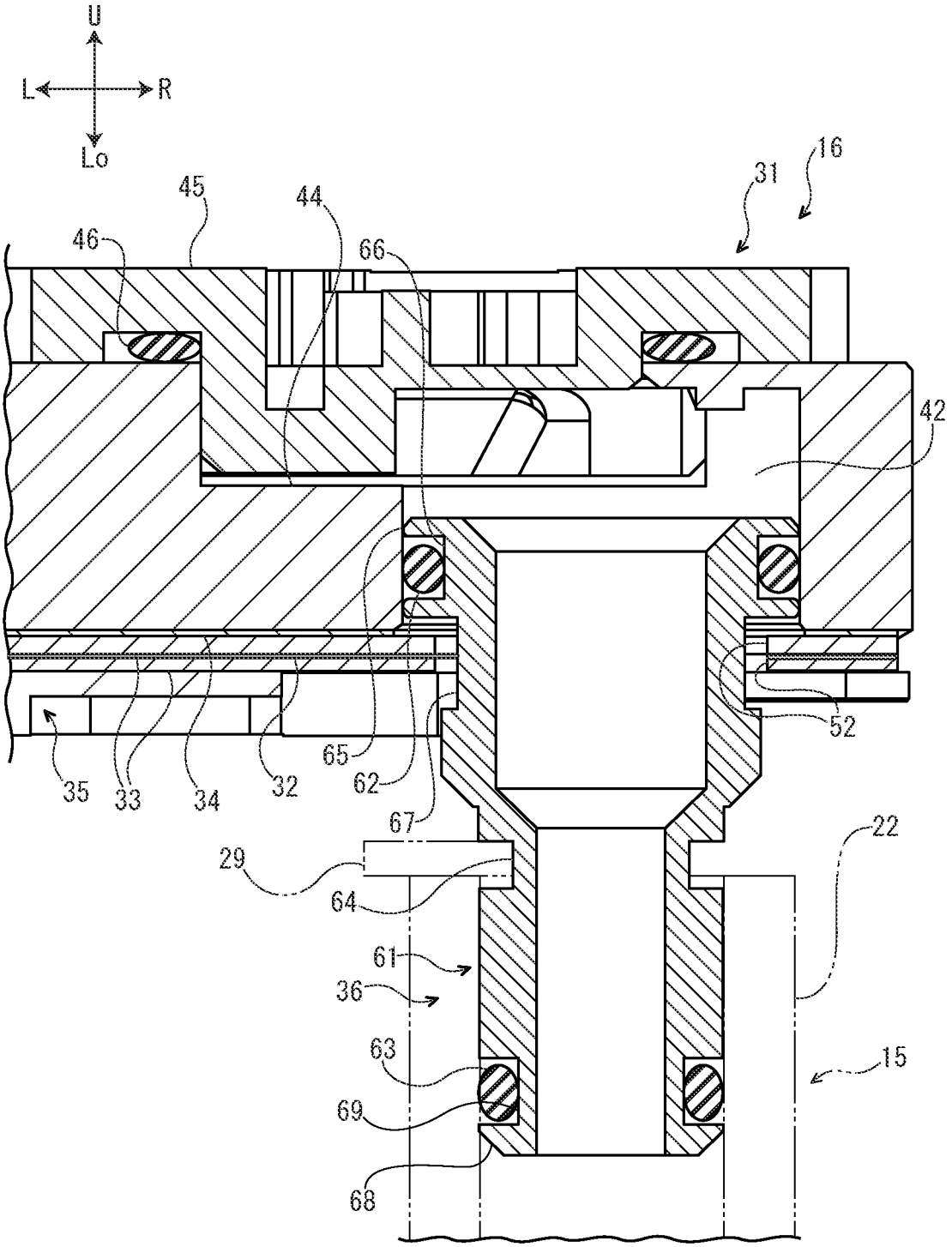
FIG. 6 is a sectional view showing the damper along a section which passes through an insertion chamber according to the embodiment of the present disclosure.

As shown in FIG. 4 to FIG. 6, the damper 16 includes a damper body 31, a film 32 located below the damper body 31, a pair of upper and lower sandwiching plates 33 sandwiching the film 32, a sealing member 34 located between the damper body 31 and the upper sandwiching plate 33, a restricting member 35 located below the film 32 and the sandwiching plates 33, and three damper side couplings 36 installed to the damper body 31. In addition, in FIG. 4, only the damper body 31 and each damper side coupling 36 in the damper 16 are schematically illustrated.

Inside of the damper body 31 of the damper 16, one damper chamber 41 is provided. The damper chamber 41 is opened downwardly. Inside of the damper body 31, three insertion chambers 42 (only one insertion chamber 42 is illustrated in FIG. 6) communicated to the damper chamber are provided. Each insertion chamber 42 is opened downwardly.

The damper body 31 includes a base part 44 and a covering part 45 covering an upper side of the base part 44. Between the base part 44 and the covering part 45, a packing 46 is located. The packing 46 is constituted of, for example, an O-shaped ring.

The film 32 of the damper 16 has flexibility, and is provided so as to be elastically deformable. The film 32 is horizontally provided in a state of being formed in a flat board shape (a state of not being deforming). The film 32 constitutes a lower surface of the damper chamber 41 by covering a lower side of the damper chamber 41.

Each sandwiching plate 33 of the damper 16 is horizontally provided. In each sandwiching plate 33, an opening 51 is provided at a position corresponding to the damper chamber 41. The opening 51 has an elliptical shape. In the sandwiching plates 33, respective through holes 52 are provided at a position corresponding to each insertion chamber 42.

The sealing member 34 of the damper 16 is constituted of, for example, a rubber sheet. An upper surface of the sealing member 34 is in contact with a lower surface of the base part 44 of the damper body 31. A lower surface of the sealing member 34 is in contact with an upper surface of the upper sandwiching plate 33.

As shown in FIG. 5, the restricting member 35 of the damper 16 includes a contacting part 55, and an opposing part 56 provided at an inner peripheral side (a side near a vertical line M passing through a center of the damper chamber 41) of the contacting part 55.

The contacting part 55 of the restricting member 35 is formed in a flat board shape. An upper surface of the contacting part 55 is in contact with a lower surface of the lower sandwiching plate 33. The contacting part 55 sandwiches the sandwiching plates 33 and the sealing member 34 together with the base part 44 of the damper body 31.

The opposing part 56 of the restricting member 35 faces to the film 32 via a gap G in a state that the film 32 is formed in a flat board shape (a state that the film 32 is not deformed). Therefore, the deforming of the film 32 in the down direction (a direction in which a volume of the damper chamber 41 is increased) is restricted to a fixed amount. A width (height) of the gap G in the up/down direction (a direction orthogonal to the film 32) becomes, in a state that the film 32 is formed in a flat board shape, wider (larger) from an outer peripheral side (a side far from the vertical line M passing through the center of the damper chamber 41) toward a center side (a side near the vertical line M passing through the center of the damper chamber 41) of the film 32.

At an outer peripheral part of the opposing part 56 of the restricting member 35, a projection part 58 is provided. The projection part 58 is projected toward the upper side than (a side of the film 32 rather than) the contacting part 55, and is inserted the opening 51 of the lower sandwiching plate 33. An upper end part of the projection part 58 is curved in a circular arc shape. At an inner peripheral part of the opposing part 56, the ventilation hole 59 which makes an outer space of the damper 16 and the gap G communicate is provided.

As shown in FIG. 6, each damper side coupling 36 in the damper 16 is connected to the head side coupling 22 of each recording head 15 from an upper side along the up/down direction. Each damper side coupling 36 is formed as the different body from the damper body 31, and is provided so as to be movable along the up/down direction with regard to the damper body 31.

Each damper side coupling 36 includes a cylindrical piece 61, and, a first seal piece 62 and a second seal piece 63 located at an outer peripheral of the cylindrical piece 61.

The cylindrical piece 61 of each damper side coupling 36 is extended along the up/down direction, and is opened upwardly and downwardly. The cylindrical piece 61 passes through the through holes 52 of the sandwiching plate 33.

At a center part in the up/down direction of the cylindrical piece 61 of each damper side coupling 36, an engaging gap 64 is provided. The stopper 29 of the head side coupling 22 of each recording head 15 is engaged with the engaging gap 64. Therefore, the downward movement of each damper side coupling 36 is restricted, and a height of each damper side coupling 36 is determined. In addition, since a width in the up/down direction of the engaging gap 64 is slightly larger than a width in the up/down direction of the stopper 29, each damper side coupling 36 can be slightly movable upwardly with regard to the damper 31 even in a state that the stopper 29 is engaged with the engaging gap 64. That is, even in the state that the stopper 29 is engaged with the engaging gap 64, the upward/downward movement of each damper side coupling 36 with regard to the damper 31 is not completely restricted.

At an upper end part of the cylindrical piece 61 of each damper side coupling 36, a first insertion part 65 is provided. The first insertion part 65 is inserted into each insertion chamber 42 provided in the damper body 31 of the damper 16. Therefore, the upper end part of the cylindrical piece 61 is communicated to each insertion chamber 42. The first insertion part 65 is positioned at the upper side than each sandwiching plate 33. An outside diameter of the first insertion part 65 is larger than an outside diameter of parts other than the first insertion part 65 in the cylindrical piece 61, and is larger than a hole diameter of the through hole 52 of each sandwiching plate 33. On an outer circumference face of the first insertion part 65, an annular first fitting gap 66 is provided.

On an outer circumference face of the cylindrical piece 61 of each damper side coupling 36, a depression 67 is provided at the lower side of the first insertion part 65. A height of the depression 67 matches a height of the through hole 52 of each sandwiching plate 33. Therefore, the depression 67 faces to the through hole 52 of each sandwiching plate 33 at an interval.

At a lower end part of the cylindrical piece 61 of each damper side coupling 36, a second insertion part 68 is provided. The second insertion part 68 is inserted into the head side coupling 22 of each recording head 15. Therefore, the lower end part of the cylindrical piece 61 is communicated to the head side coupling 22 of each recording head 15. In the second insertion part 68, an annular second fitting gap 69 is provided.

The first seal piece 62 of each damper side coupling 36 is constituted of, for example, an O-shaped ring. The first seal piece 62 is in contact with the outer circumference face of the first insertion part 65 of the cylindrical piece 61 and an inner circumference face of each insertion chamber 42. The first seal piece 62 is fitted into the first fitting gap 66 of the first insertion part 65.

The second seal piece 63 of each damper side coupling 36 is constitute of, for example, an O-shaped ring. The second seal piece 63 is in contact with an outer circumference face of the second insertion part 68 of the cylindrical piece 61 and an inner circumference face of the head side coupling 22 of each recording head 15. The second seal piece 63 is fitted into the second fitting gap 69 of the second insertion part 68.

Next, supply of the ink from the ink container 11 to each nozzle 27 of each recording head 15 will be described.

The ink contained in the ink container 11 is supplied to the sub tank 12 via the first flow path Q1, and is temporally stored in the sub tank 12. The ink temporally stored in the sub tank 12 flows to the damper 16 via the second flow path Q2 and the third flow path Q3. The ink flowed to the damper 16 flows to the ink flow path 25 provided in the head body 21 of each recording head 15 via each damper side coupling 36 and the head side coupling 22 of each recording head 15. The ink flowed to the ink flow path 25 is supplied from the ink flow path 25 to each nozzle 27 of each recording head 15. As described above, the damper 16 distributes the ink supplied from the ink container 11 to the respective recording heads 15.

Next, normal print operation and purge operation will be described.

When the normal print operation is performed, the ink in each nozzle 27 of each recording head 15 is pressurized by a piezoelectric element (not shown) provided in each nozzle 27 in a state that the sheet S faces to each nozzle 27. Accordingly, the ink is discharged from each nozzle 27 to the sheet S, and then, an image is formed on the sheet S.

On the other hand, when the purge operation is performed, the pump 13 is driven in a state that the sheet S does not face to each nozzle 27 of each recording head 15. Accordingly, pressure of the ink in each nozzle 27 is increased, and the ink is forcibly discharged from each nozzle 27, and thereby, clogging of each nozzle 27 is solved.

Next, an action of the damper 16 will be described.

When pressure of the ink in the damper chamber 41 is decreased, the film 32 is deformed upwardly. Thereby, the volume of the damper chamber 41 becomes small, and then, the decrease in the pressure of the ink in the damper chamber 41 is relieved.

On the other hand, when the pressure of the ink in the damper chamber 41 is increased, the film 32 is deformed downwardly. Thereby, the volume of the damper chamber 41 becomes large, and then, the increase in the pressure of the ink in the damper chamber 41 is relieved.

As described above, the film 32 is deformed according to pressure variation of the ink in the damper chamber 41, and makes the volume of the damper chamber 41 change. Accordingly, the pressure variation of the ink in the damper chamber 41 is reduced. Thus, pressure variation of the ink in the ink flow path 25 communicated to the damper chamber 41 and pressure variation of the ink in each nozzle 27 communicated to the ink flow path 25 are reduced. Thereby, the flow of the ink in each recording head 15 is stabilized.

In the embodiment, as described above, the one damper 16 is provided in common to the three recording heads 15. Therefore, constitution of the ink discharge device 6 can be simplified compared with a case where the same number of the dampers 16 are provided corresponding to the three recording heads 15, and costs can be reduced. In addition, in the embodiment, since each recording head 15 and the damper 16 are connected by the couplings 22 and 36, an assembly property of each recording head 15 and the damper 16 can be improved.

On the other hand, when the one damper 16 is provided in common to the three recording heads 15 like this and each recording head 15 and the damper 16 are connected by the couplings 22 and 36, a problem as described below may occur.

As shown in FIG. 4, in the ink discharge device 6 having the three recording heads 15 as described above, in order to suppress dispersion in distances D (that is, "throw distances") from the nozzle faces 26 of the respective recording heads 15 to the sheet S, it is necessary to match heights of the nozzle faces 26 of the respective recording heads 15 to each other. On the other hand, with respect to heights from the nozzle faces 26 of the respective recording heads 15 to the head side couplings 22, variation may occur for each individual. Therefore, when the heights of the nozzle faces 26 of the respective recording head 15 are matched each other as described above, variation a may occur in a height of the head side coupling 22 of each recording head 15. When the variation a occurs in the height of the head side coupling 22 of each recording head 15 like this, a part of the head side couplings 22 may not match the corresponding damper side coupling 36 in a height. Thereby, it may become difficult to attach the damper 16 to each recording head 15.

And so, in the embodiment, each damper side coupling 36 is provided so as to be movable along the up/down direction. By adopting such constitution, even if the variation a occurs in the height of the head side coupling 22 of each recording head 15, by changing the height of each damper side coupling 36 according to the height of the head side coupling 22 of each recording head 15, the head side coupling 22 of each recording head 15 and each damper side coupling 36 can be matched in a height. That is, by changing the height of each damper side coupling 36, the variation a of the head side coupling 22 of each recording head 15 can be suppressed. Therefore, the damper 16 can be surely attached to each recording head 15.

In addition, each damper side coupling 36 is provided so as to be movable along the up/down direction with regard to the damper body 31. By adopting such constitution, compared with a case of moving each damper side coupling 36 along the up/down direction together with the damper body 31, it is possible to move each damper side coupling 36 along the up/down direction easily and smoothly.

In addition, each damper side coupling 36 includes the cylindrical piece 61 having the first insertion part 65 inserted into each insertion chamber 42 and the first seal piece 62 being in contact with the outer circumference face of the first insertion part 65 and the inner circumference face of each insertion chamber 42. By adopting such constitution, it is possible to move each damper side coupling 36 along the up/down direction and to surely suppress ink leakage between the damper 31 and each damper side coupling 36.

In addition, in the outer circumference face of the first insertion part 65, the annular first fitting gap 66 is provided, and the first seal piece 62 is fitted to the first fitting gap 66. By adopting such constitution, it is possible to suppress the first seal piece 62 from falling off from the first insertion part 65 by brief constitution.

In addition, the cylindrical piece 61 passes through the respective through holes 52 provided in the sandwiching plate 33, the first insertion part 65 is positioned at the upper side than each sandwiching plate 33, and the outside diameter of the first insertion part 65 is larger than the outside diameter of the through hole 52. By adopting such constitution, it is possible to suppress each damper side coupling 36 from falling off from the damper 31 by using each sandwiching plate 33.

In addition, on the outer circumference face of the cylindrical piece 61, the depression 67 is provided at the lower side of the first insertion 65, and the height of the depression 67 matches the height of the through hole 52. By adopting such constitution, it is possible to sufficiently secure an interval between the outer circumference face of the cylindrical piece 61 and the through hole 52 and to avoid such situation in which the outer circumference face of the cylindrical piece 61 is in contact with the through hole 52 and the upward/downward movement in each damper side coupling 36 is inhibited.

In addition, the damper 16 distributes the ink supplied from the ink container 11 to the respective recording heads 15. By adopting such constitution, it is possible to make the damper 16, which has a function for reducing the pressure variation of the ink, have a function for distributing the ink, and therefore, it is possible to make the damper 16 multifunctional.

In addition, the head side coupling 22 of each recording head 15 is connected to the end part at the upstream side of the ink flow path 25. By adopting such constitution, the damper 16 is connected to the end part at the upstream side of the ink flow path 25 via the couplings 22 and 36. Therefore, the damper 16 can surely reduce the pressure variation of the ink in each recording head 15 which occurs when the ink is discharged from each nozzle 27.

In addition, the image forming apparatus 1 includes the ink discharge device 6 having such constitution as described above. Therefore, it is possible to provide the image forming apparatus 1 including the ink discharge device 6 capable of surely attaching the damper 16 to each recording head 15.

In the embodiment, each damper side coupling 36 is provided so as to be movable along the up/down direction with regard to the damper body 31. On the other hand, in another different embodiment, each damper side coupling 36 may be moved along the up/down direction together with the damper body 31.

In the embodiment, the ink supplied from the ink container 11 is distributed to the respective recording heads 15 by the damper 16. On the other hand, in another different embodiment, the ink supplied from the ink container 11 may be distributed to the respective recording head 15 by a member other than the damper 16.

In the embodiment, a piezo system in which the ink is discharged by pressurizing the ink with the piezoelectric element (not shown) is adopted. On the other hand, in another different embodiment, a thermal system in which the ink is discharged with a pressure of air bubbles which is produced by heating the ink with a heating element (not shown) may be adopted. Furthermore, in another different embodiment, a system other than the piezo system and the thermal system may be adopted.

In the embodiment, the color printer is applied as an example of the image forming apparatus 1. On the other hand, in another different embodiment, a monochrome printer, a copy machine, a facsimile, a multifunction peripheral (an image forming apparatus including a print function, a copy function, and fax function and others in a composite manner) or the like may be applied as the example of the image forming apparatus 1.

The above-description of the embodiment of the present disclosure was described about a preferable embodiment of the ink discharge device and the image forming apparatus according to the disclosure. However, the technical scope of the present disclosure is not limited to the embodiments.

The invention claimed is:

1. An ink discharge device comprising:
one or more recording heads discharging an ink; and
a damper,
wherein the recording head includes a head side coupling,
the damper includes a damper side coupling which is connected to the head side coupling along a connecting direction,
the damper side coupling is provided so as to be movable along the connecting direction.

2. The ink discharge device according to claim 1, wherein
the one or more recording heads are a plurality of recording heads,
the damper is one damper which is provided in common to the plurality of recording heads.

3. The ink discharge device according to claim 1, wherein
the damper further includes:
a damper body having a damper chamber; and
a film deforming according to pressure variation of an ink in the damper chamber, and making a volume of the damper chamber change,
the damper side coupling is provided so as to be movable along the connecting direction with regard to the damper body.

4. The ink discharge device according to claim 3, wherein
the damper body has an insertion chamber communicated to the damper chamber,
the damper side coupling includes:
a cylindrical piece having an insertion part inserted into the insertion chamber; and
a seal piece being in contact with an outer circumference face of the insertion part and an inner circumference face of the insertion chamber.

5. The ink discharge device according to claim 4, wherein
on the outer circumference face of the insertion part, an annular fitting gap is provided,
the seal piece is fitted into the fitting gap.

6. The ink discharge device according to claim 4, wherein
the damper further includes a pair of sandwiching plates sandwiching the film,
the cylindrical piece passes through through holes respectively provided in the sandwiching plates,
the insertion part is positioned at a deep side in an inserting direction of the insertion part than each of the sandwiching plates,
an outside diameter of the insertion part is larger than a hole diameter of the through hole.

7. The ink discharge device according to claim 6, wherein
on an outer circumference face of the cylindrical piece, a depression is provided at a front side in the inserting direction than the insertion part,
a position in the inserting direction of the depression is matched a position in the inserting direction of the through hole.

8. The ink discharge device according to claim 1 further comprising:
an ink container containing an ink,
wherein the damper supplies an ink supplied from the ink container to the recording head.

9. The ink discharge device according to claim 1, wherein
in the recording head, an ink flow path in which an ink flows is provided,
the head side coupling is connected to an end part at an upstream side of the ink flow path.

10. The ink discharge device according to claim 1, wherein
the head side coupling includes a stopper which is movable in a direction orthogonal to the connecting direction,
the damper side coupling includes an engaging gap which is larger than the stopper in the connecting direction,
the stopper is engaged with the engaging gap.

11. An image forming apparatus comprising:
an apparatus body having a conveying path of a recording medium; and
the ink discharge device according to claim 1, which discharges the ink to the recording medium conveyed on the conveying path.

12. An ink discharge device comprising:
one or more recording heads discharging an ink; and
a damper,
wherein the recording head includes a head side coupling,
the damper includes a damper side coupling which is connected to the head side coupling along a connecting direction,
the head side coupling is provided, in a state being connected to the damper side coupling, so as to be movable along the connecting direction.

13. The ink discharge device according to claim 12, wherein
the one or more recording heads are a plurality of recording heads,
the damper is one damper which is provided in common to the plurality of recording heads.

14. The ink discharge device according to claim 12, wherein
the damper further includes:
a damper body having a damper chamber; and
a film deforming according to pressure variation of an ink in the damper chamber, and making a volume of the damper chamber change,
the head side coupling is provided so as to be movable along the connecting direction with regard to the damper body.

15. The ink discharge device according to claim 14, wherein
the damper body has an insertion chamber communicated to the damper chamber,
the damper side coupling includes:
a cylindrical piece having an insertion part inserted into the insertion chamber; and
a seal piece being in contact with an outer circumference face of the insertion part and an inner circumference face of the insertion chamber.

16. The ink discharge device according to claim 12 further comprising:
an ink container containing an ink,
wherein the damper supplies an ink supplied from the ink container to the recording head.

17. The ink discharge device according to claim 12, wherein
in the recording head, an ink flow path in which an ink flows is provided,
the head side coupling is connected to an end part at an upstream side of the ink flow path.

18. The ink discharge device according to claim 12, wherein
the head side coupling includes a stopper which is movable in a direction orthogonal to the connecting direction, the damper side coupling includes an engaging gap which is larger than the stopper in the connecting direction, the stopper is engaged with the engaging gap.

19. An image forming apparatus comprising:

an apparatus body having a conveying path of a recording medium; and the ink discharge device according to claim 12, which discharges the ink to the recording medium conveyed on the conveying path.

* * * * *